US006380501B1

(12) United States Patent
Figueroa et al.

(10) Patent No.: US 6,380,501 B1
(45) Date of Patent: Apr. 30, 2002

(54) TRIP INDICATION CAPABILITY FOR CIRCUIT BREAKER REMOTE HANDLE OPERATOR

(75) Inventors: Alberto A. Figueroa, Southington; Joseph Criniti, New Britain; Farshid Attarian, Collinsville; Javier Ignacio Larranaga; Joseph B. Kalaita, both of Bristol, all of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/640,698

(22) Filed: Aug. 17, 2000

(51) Int. Cl.[7] ..... H01H 9/16
(52) U.S. Cl. ..... 200/308; 200/331
(58) Field of Search ..... 200/50.26, 400, 200/401, 308, 330, 331, 333, 334, 337

(56) References Cited

U.S. PATENT DOCUMENTS 4,392,036 A 7/1983 Troebel et al. ..... 200/322
5,120,921 A 6/1992 Dimarco et al. ..... 200/401
5,296,664 A 3/1994 Crookston et al. ..... 200/401
5,457,295 A 10/1995 Tanibe et al. ..... 200/293
5,981,887 A * 11/1999 Robarge et al. ..... 200/308
6,107,902 A * 8/2000 Zhang et al. ..... 335/17
6,222,433 B1 * 4/2001 Ramakrishnan et al. ..... 335/17

* cited by examiner

*Primary Examiner*—Michael Friedhofer
(74) *Attorney, Agent, or Firm*—Gantor Colburn LLP

(57) ABSTRACT

A trip indicator for handle operator for controlling a handle of a circuit breaker comprises a cover having a window sufficiently sized to view indicia indicating a position of the handle, a trip flag having indicia indicating a TRIPPED condition, and a connection between a chuck of the handle operator and the trip flag configured to move the trip flag such that the indicia is visible through the window when the handle is in a TRIPPED position and is not visible through said window when the handle is not in the TRIPPED position.

15 Claims, 3 Drawing Sheets

TRIP INDICATION CAPABILITY FOR CIRCUIT BREAKER REMOTE HANDLE OPERATOR

BACKGROUND OF THE INVENTION

This application relates to circuit breaker remote handle operators. More specifically, this application relates to a trip indicator for circuit breaker remote handle operators.

Remote handle operators are available to remotely operate a circuit breaker, i.e., to turn on, off, or reset the circuit breaker from a remote location. Remote handle operators work by attaching to the front face of the circuit breaker and engaging a chuck on the circuit breaker handle to physically operate the circuit breaker. A chuck disposed on the circuit breaker handle is operated by a solenoid or motor which is operated by a control unit at the remote location.

A drawback to using a remote handle operator is that the remote handle operator covers the handle of the circuit breaker, making it impossible determine which position the handle is in unless some indicator is provided by the remote handle operator.

It has been known to provide a window on the case of the remote handle operator with a label mounted to the handle chuck or a part that moves with the handle chuck to indicate whether the handle is in an ON position or OFF position. However, it would also be desirable to know when the circuit breaker has been tripped. When a circuit breaker trips, the handle moves slightly away from the ON position. Unfortunately, this movement is not visible on circuit breakers with remote handle operators.

BRIEF SUMMARY OF THE INVENTION

To overcome the limitations of the prior art, the present invention provides a trip indicator for handle operator for controlling a handle of a circuit breaker comprising a cover having a window sufficiently sized to view indicia indicating a position of the handle, a trip flag having indicia indicating a TRIPPED condition, and a connection between a chuck of the handle operator and the trip flag configured to move the trip flag such that the indicia is visible through the window when the handle is in a TRIPPED position and is not visible through said window when the handle is not in the TRIPPED position.

BRIEF DESCRIPTION OF THE DRAWINGS

Referring now to the exemplary drawings wherein like elements are numbered alike in the several FIGURES.

DETAILED DESCRIPTION OF THE INVENTION

Figure 1:
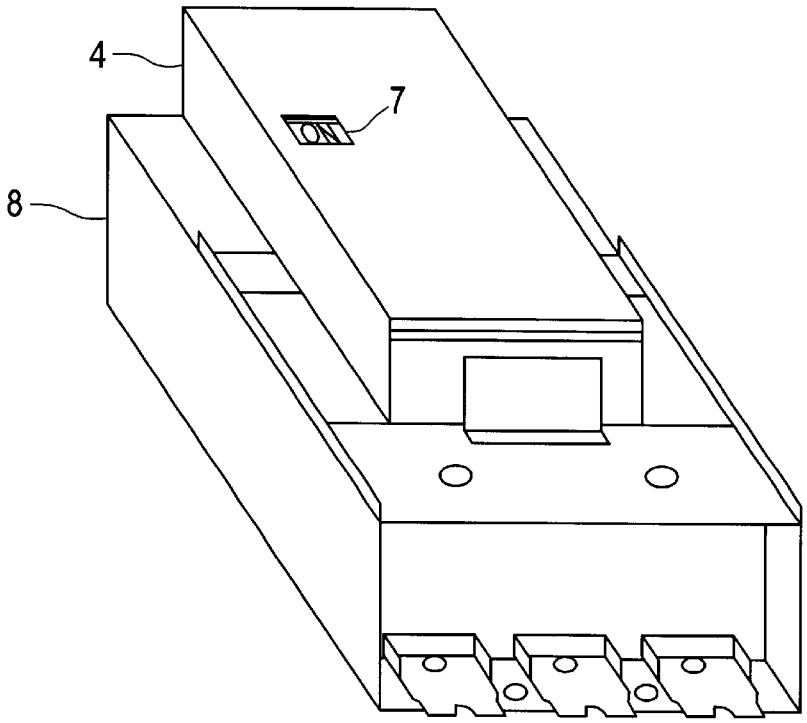
FIG. 1 PRIOR ART
FIG. 1 shows a circuit breaker with a handle operator instaled.
Figure 2:
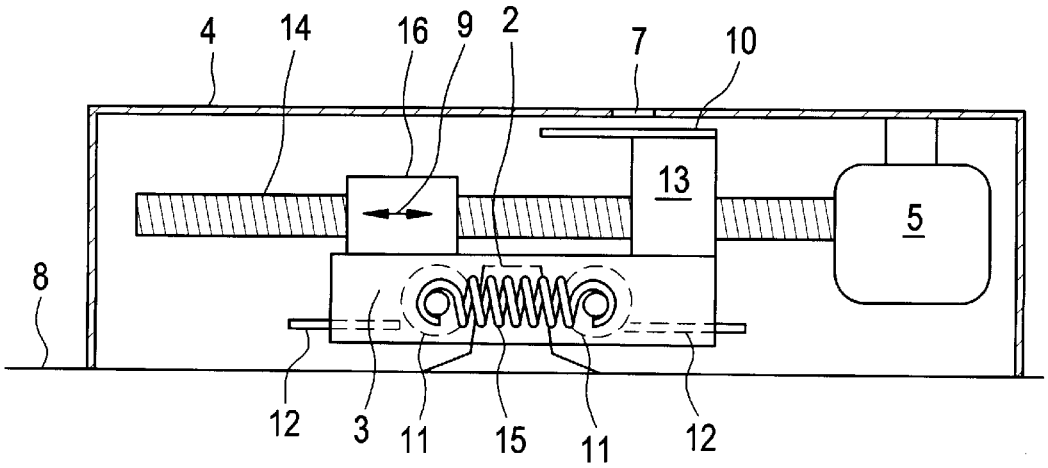
FIG. 2 PRIOR ART
FIG. 2 shows a simplified cross section view of the remote handle operator in engagement with a handle of a circuit breaker.

Referring to FIGS. 1 and 2, a prior art circuit breaker unit 8 has a remote handle operator 4 installed, covering circuit breaker handle 2 so that its position cannot be seen. Remote handle operator 4 includes a chuck 3 which engages handle 2 and operates it via motor 5. Handle 2 is operated to turn the circuit breaker OFF or ON by two-way motor 5 which rotates jack-screw 14 causing threaded block 16 moves up or down in the direction of the arrow 9. Chuck 3 is connected to threaded block 8 and includes rollers 11 that directly engage handle 2. Spring 15 allows chuck 3 to move in response to the handle movement when circuit breaker 8 is tripped, regardless of any movement of threaded block 16. Plates 12 ensure that when remote handle operator 4 is positioned on circuit breaker 8, handle 2 extends between rollers 11. To reset handle 2 after the circuit breaker trips, the handle is moved to the OFF position, then to the ON position.

Connected to chuck 3 is extension 13 for supporting indicator flag 10. The remote handle operator includes a window 7 through which a portion of indicator flag 10 is visible. When the handle moves from an on position to an off position or vice-versa, indicator flag 10 moves thereby changing the portion of indicator flag 10 that is visible through window 7. When circuit breaker ON, the portion of indicator flag 10 that is visible includes indicia for "ON" and when the circuit breaker is OFF, the portion of indicator flag 10 that is visible includes indicia for "OFF". As discussed above in the background section above, there has heretofore been no known way of clearly indicating when the breaker is in a TRIPPED position, since it is relatively close to the ON position and thus the indicia for "ON" may still be visible or partially visible in window 7 even though the unit has tripped.

Figure 3:
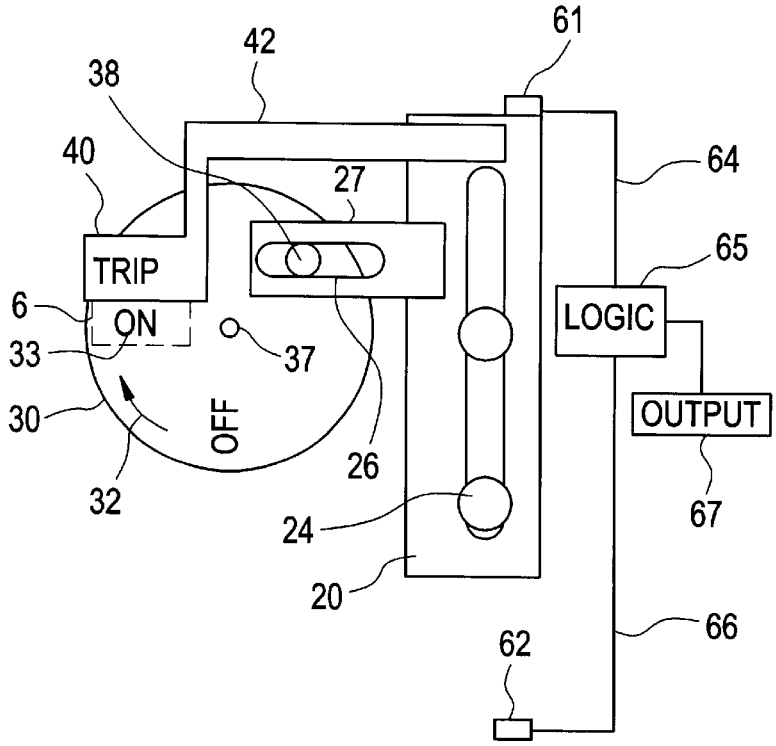
FIGS. 3, 4 and 5 show a trip indicator according to a preferred embodiment in ON, OFF, and TRIP positions, respectively.
Figure 4:
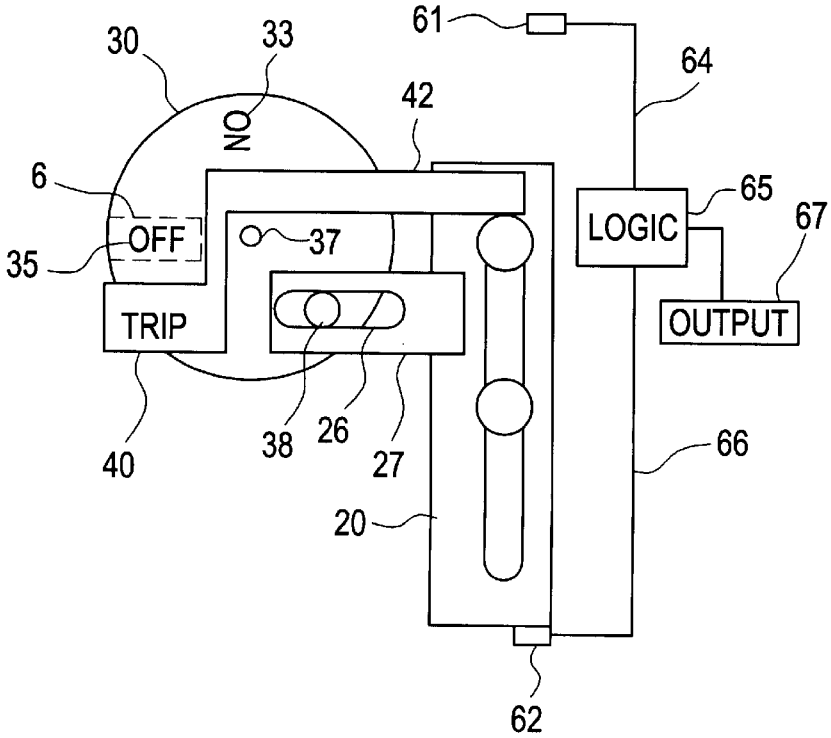
Figure 5:
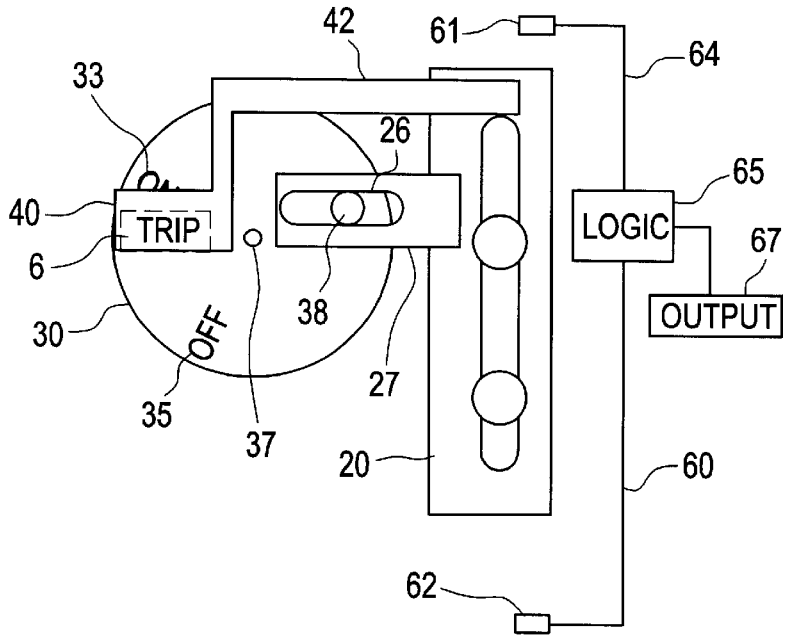

Turning to FIGS. 3 through 5, the present invention has solved this problem by providing a slider 20, trip flag support 42, trip flag 40, dial drive positioner 27, and dial 30 having an ON label 33 and an OFF label 35. Slider 20 slides along slide posts 24 under the influence of chuck 3 such as that shown in FIG. 2. Trip flag support 42, trip flag 40 and dial drive positioner 27 are fixed to slider 20 so they move as one. Dial 30 rotates on pin 37 and is positioned by pin 38 captured in slot 26 of positioner 27. As the slider slides down from the position shown in FIG. 3, positioner 27 forces dial 30 to rotate clockwise as shown by arrow 32.

Although the prior art shows a motor driven jack screw (shown in FIG. 2) for positioning said chuck, the invention contemplates other configurations, such as the use of a solenoid, spring operated, pneumatic or hydraulic positioner. Regardless of the means for motivating the chuck assembly, the chuck must also respond to movement of the circuit breaker handle in the case of the circuit breaker being tripped.

Looking now to FIG. 4, slider 20 is in its lowest position. The trip flag is below indicator window position 6 and dial 30 has rotated to the OFF position wherein the word "OFF" is aligned with window position 6. When the breaker is ON (FIG. 3) and then trips, the force and stroke provided by the handle displacement provides the motion and force necessary to move slide 20 and position trip indicator flag 40 into alignment with window 7 at window position 6, as shown in FIG. 5. Because of the opposite motions of dial 30 and flag 40 and because of the mechanical advantage gained by the dial 30, ON label 33 can be covered and "TRIP" can be displayed with a very short stroke.

In addition to mechanically displaying an ON-OFF-TRIP indicator, the present invention also contemplates providing an electronic annunciation or communication of the condition of the circuit breaker. For remote handle operators having electronic annunciation or communication capability, it is necessary for handle operator 4 to have some sensing means to sense the position of handle 2 of the circuit breaker 8. To sense the three possible positions, ON, OFF, and TRIP, of handle 2, and therefore chuck 3, slider 20, or some other part of the assembly shown in FIG. 2 that moves with chuck 3, is provided with two position sensors 61 and 62 to detect slider being in an ON position as shown in FIG. 2, or an OFF position as shown in FIG. 3. Sensors 61 and 62 may be of any type capable of detecting the proximity of slider 20. For example, sensors 61 and 62 may be electrical contacts designed to complete a circuit of which slider 20 is a part, or they may be mechanical switches, such as micro-switches, or they may proximity sensors such as Hall-effect sensors or other magnetic sensors, or they may be optical sensors capable of sensing the position of slider 20, or a projection therefrom, in a known manner.

When the circuit breaker is in the ON position, slide 20 is positioned so that it is adjacent to sensor 61 and not adjacent to sensor 62 as shown in FIG. 3. In response to the proximity of slide 20, sensor 61 sends a signal indicative of a proximity of slide 20 along line 64 to logic circuit 65. Since slide 20 is not proximate sensor 62, sensor 62 does not send a signal indicative of proximity of slide 20 along line 66 to logic circuit 65. Logic circuit 65 can then interpret the presence of a proximity signal from only sensor 61 as an indication that the circuit breaker is in the ON position, and then output this information to output 67, which may be a display, alarm, or communications port to a monitor or controlling computer.

When the circuit breaker is in the OFF position, slide 20 is positioned so that it is adjacent to sensor 62 and not adjacent to sensor 61 as shown in FIG. 4. In response to the proximity of slide 20, sensor 62 sends a signal indicative of a proximity of slide along line 66 to logic circuit 65. Since slide 20 is not proximate sensor 61, sensor 61 does not send a signal indicative of proximity of slide 20 along line 64 to logic circuit 65. Logic circuit 65 can then interpret the presence of a proximity signal from only sensor 62 as an indication that the circuit breaker is in the OFF position, and then output this information to output 67, which may be a display, alarm, or communications port to a monitoring or controlling computer.

When the circuit breaker is in the TRIP position, slide 20 is positioned intermediate sensor 61 and 62, and is not adjacent to either of them as shown in FIG. 5. In this case, neither sensor 61 nor sensor 62 send a signal indicative of the proximity of slide 20 along lines 64 and 66 to logic circuit 65. Logic circuit 65 can then interpret the absence of a proximity signal from either sensor 61 or 62 as an indication that the circuit breaker is in the TRIP position, and then output this information to output 67, which may be a display, alarm, or communications port to a monitoring or controlling computer.

Figure 6:
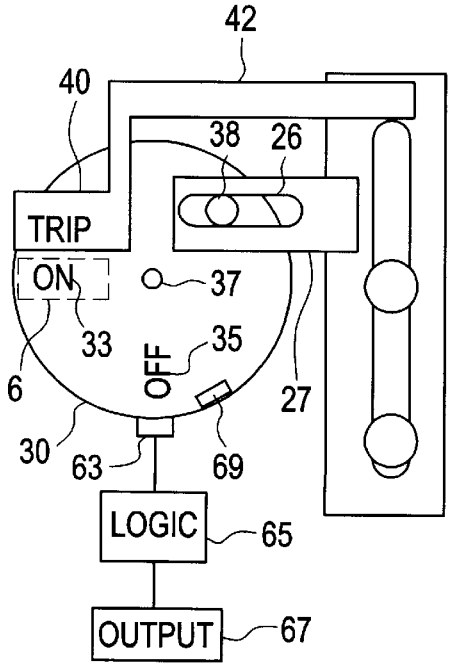
FIGS. 6 and 7 show another embodiment of a trip indicator of the invention in ON and TRIP positions, respectively.
Figure 7:
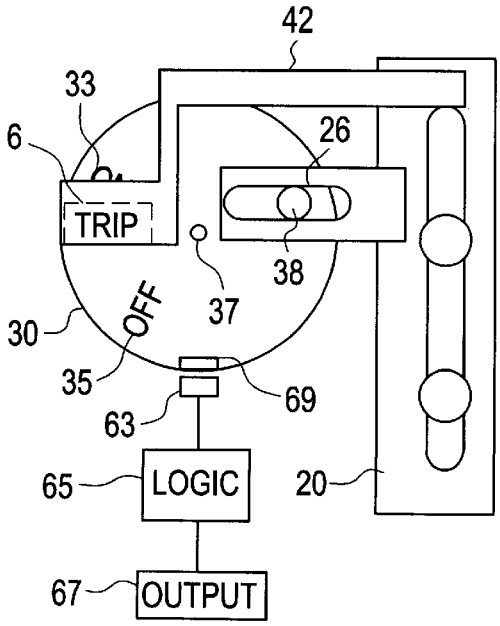

An alternative embodiment is shown in FIGS. 5 and 6. In this embodiment, sensor 63 detects the proximity of element 69 on dial 30 when in the TRIP position shown in FIG. 7. Sensor 63 is any type of proximity sensor such as discussed above with respect to sensors 61 and 62. FIG. 5 shows the position of sensor 63 when dial 30 is in the ON position. When the circuit breaker trips, slider 20 slides slightly down from the position shown in FIG. 5 to the position shown in FIG. 6. As the slider slides down, it forces dial 30 to rotate slightly clockwise as shown in FIG. 7 sensor 63 comes into proximity with sensor element 69, causing sensor 63 to transmit a proximity signal to logic circuit 65 which interprets the presence of such signal as an indication that the circuit breaker is in the TRIP position, and then outputs this information to output 67, which may be a display, alarm, or communications port to a monitoring or controlling computer.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A handle operator for controlling a handle of a circuit breaker comprising;

a cover having a window sufficiently sized to view indicia indicating a position of said handle;

a trip flag having indicia indicating a TRIPPED condition;

a chuck operably coupled to said handle;

a means for driving said chuck to position said operating handle between an ON position and an OFF position; and a connection between said chuck and said trip flag configured to move said trip flag such that said indicia is visible through said window when said handle is in a TRIPPED position and is not visible through said window when said handle is not in said TRIPPED position.

2. The handle operator of claim 1, further comprising:

a movable display having indicia indicating an ON position; and wherein said connection is configured to move said movable display such that said indicia indicating said ON position is visible through said window when said handle is in said ON position and is not visible through said window when said handle is in said OFF position.

3. The handle operator of claim 1, further comprising:

a movable display having indicia indicating an OFF position; and wherein said connection is configured to move said movable display such that said indicia indicating said OFF position is visible through said window when said handle is in said OFF position and is not visible through said window when said handle is in said ON position.

4. The handle operator of claim 1, further comprising:

a proximity sensor configured to produce a proximity signal when said handle is in said TRIPPED position.

5. The handle operator of claim 1, further comprising:

a first proximity sensor producing a first proximity signal when said handle is in an ON position; and a second proximity sensor configured to produce a second proximity signal when said handle is in said TRIPPED position.

6. A trip indicator for a handle operator for controlling a handle of a circuit breaker comprising a cover having a window sufficiently sized to view indicia indicating a position of said handle;

a first movable display positioned beneath said window having indicia thereon indicating an ON position of said handle and an OFF position of said handle;

a second movable display positioned beneath said aperture having indicia thereon indicating a TRIPPED position of said handle; and motivating means and interlocking means responsive to movements of a chuck connected to said handle; and said motivating means and said interlocking means configured so that one of said first movable display and said second movable display moves in a first direction beneath said window and another of said first movable display and said second movable display moves in a second direction beneath said window, and said first and second direction being substantially opposite each other;

whereby said one of said indicia corresponding a position of said handle is visible through said window.

7. The trip indicator set forth in claim 6 wherein said second movable display is positioned between said first movable display and said cover.

8. The trip indicator set forth in claim 6 wherein said motivating means comprises a slide that moves with said chuck;

said first movable display comprises a rotating disc, and said interlocking means comprises a positioner that engages said first movable display and translates the linear motion of said slide to rotational motion of said first movable display.

9. The trip indicator set forth in claim 6 further comprising:

a first proximity sensor producing a proximity signal when said motivating means is in a position corresponding to said ON position of said handle;

a second proximity sensor producing a proximity signal when said motivating means is in a position corresponding to said OFF position of said handle;

a logic circuit receiving said proximity signals and generating an output signal corresponding to said ON position, said OFF position, and said TRIPPED position of said handle.

10. The trip indicator set forth in claim 6 further comprising:

a proximity sensor positioned and configured to produce a proximity signal when said handle is in said TRIPPED position.

11. A remote circuit breaker handle operator comprising:

a chuck for following and controlling a handle of a circuit breaker, said chuck being positionable in an ON position, an OFF position, and a TRIPPED position;

a means for moving said chuck into said ON position and said OFF position;

a means for allowing said chuck to be moved into said TRIPPED position in response to a circuit breaker being tripped;

a cover having a window sufficiently sized to view indicia indicating a position of said handle;

a first movable display positioned beneath said window having indicia thereon for indicating an ON position of said handle and an OFF position of said handle;

a second movable display positioned beneath said aperture having indicia thereon for indicating a TRIPPED position of said handle; and a motivating means connected to said chuck for following the movement of said chuck;

interlocking means connected to said motivating means;

said motivating means and said interlocking means configured so that one of said first movable display and said second movable display moves in a first direction beneath said window and another of said first movable display and said second movable display moves in a second direction beneath said window, and said first and second direction being substantially opposite each other;

whereby said one of said indicia corresponding a position of said handle is visible through said window.

12. The remote circuit breaker handle operator set forth in claim 11 wherein said second movable display is positioned between said first movable display and said cover.

13. The remote circuit breaker handle operator set forth in claim 4 wherein said motivating means comprises a slide that moves with said chuck;

said first movable display comprises a rotating disc, and said interlocking means comprises a positioner that engages said first movable display and translates the linear motion of said slide to rotational motion of said first movable display.

14. The remote circuit breaker handle operator set forth in claim 4 further comprising:

a first proximity sensor producing a proximity signal when said motivating means is in a position corresponding to said ON position of said chuck;

a second proximity sensor producing a proximity signal when said motivating means is in a position corresponding to said OFF position of said chuck;

a logic circuit receiving said proximity signals and generating an output signal corresponding to said ON position, said OFF position, and said TRIPPED position of said chuck.

15. The remote circuit breaker handle operator set forth in claim 11 further comprising:

a proximity sensor positioned and configured to produce a proximity signal when said chuck is in said TRIPPED position.

* * * * *